US005396949A

United States Patent [19]

Kawabata et al.

[11] Patent Number: 5,396,949

[45] Date of Patent: Mar. 14, 1995

[54] MESH FIN TYPE HEAT EXCHANGER AND METHOD OF MAKING THE SAME

[75] Inventors: Katsuhiro Kawabata; Hiroyuki Yamashita; Kouichi Yasuo; Kenichi Suehiro, all of Osaka, Japan

[73] Assignee: Daikin Industries, Ltd., Osaka, Japan

[21] Appl. No.: 204,198

[22] PCT Filed: Jun. 30, 1993

[86] PCT No.: PCT/JP93/00899

§ 371 Date: Mar. 1, 1994

§ 102(e) Date: Mar. 1, 1994

[87] PCT Pub. No.: WO94/00821

PCT Pub. Date: Jan. 6, 1994

[30] Foreign Application Priority Data

Jul. 3, 1992 [JP] Japan ..... 4-177030

[51] Int. Cl.[6] ..... F28F 1/44

[52] U.S. Cl. ..... 165/179; 165/171; 165/183; 29/890.046

[58] Field of Search ..... 165/171, 179, 183; 29/890.046, 890.047

[56] References Cited

U.S. PATENT DOCUMENTS

| | | | |
|---|---|---|---|
| 2,107,031 | 2/1938 | Evans | 165/183 |
| 2,112,743 | 3/1938 | Poole | 165/185 |
| 3,409,075 | 11/1968 | Long | 165/179 |
| 3,460,613 | 8/1969 | Kritzer | 165/171 X |
| 4,071,935 | 2/1978 | Molitor | 165/171 X |

FOREIGN PATENT DOCUMENTS

| | | | |
|---|---|---|---|
| 643979 | 7/1962 | Canada | 165/179 |
| 1500641 | 11/1967 | France | 165/179 |
| 2668250A | 4/1992 | France | 165/171 |
| 276815 | 1/1914 | Germany | 165/183 |
| 1551472 | 8/1970 | Germany . | |
| 52-108546 | 9/1977 | Japan . | |
| 63-189794 | 8/1988 | Japan | 165/183 |
| 398657 | 5/1962 | Switzerland . | |
| 619307 | 3/1949 | United Kingdom . | |

*Primary Examiner*—Allen J. Flanigan

[57] ABSTRACT

The heat exchanger includes a plurality of heat transfer tubes 1, 1 . . . arranged in parallel, and a multiplicity of mesh-form fins 2, 2 . . . arranged parallel to axes of the tubes and joined to the heat transfer tubes 1, 1 . . . Each of the heat transfer tubes 1 consists of a pair of tube component members 4, 4 of a half cylindrical configuration having, at their respective circumferential ends, joining flanges 4*a*, 4*b* extending along the axis of the tube. The opposed joining flanges 4*a*, 4*b* of the tube component members 4, 4 are joined together by being pressed against the fins 2, 2 from outer side thereof. This provides for improvement in operating efficiency in the process of assembling heat transfer tubes and mesh-form fins together.

7 Claims, 6 Drawing Sheets

MESH FIN TYPE HEAT EXCHANGER AND METHOD OF MAKING THE SAME

FIELD OF THE INVENTION

The present invention relates to a mesh fin type heat exchanger including a multiplicity of heat transfer tubes arranged in parallel and a multiplicity of mesh-form fins arranged parallel to the axes of the heat transfer tubes and joined to the heat transfer tubes, and to a method of making the same.

BACKGROUND ART

Heat exchangers of a cross fin coil type have hitherto been widely used which has a multiplicity of heat transfer tubes arranged in parallel and a multiplicity of lamellar fins arranged orthogonally to the heat transfer tubes. In order to improve the heat transfer performance of heat exchangers of this type, it has been conventional to work the fins in various ways (as, for example, by providing notched and bent pieces of various configurations on the surfaces of the fins). However, such fin working have a limitation on the effectiveness for the improvement of the heat transfer performance.

Therefore, attempts have recently been made to develop heat exchangers having a new constructional arrangement which are known as mesh fin type heat exchangers (see, for example, Japanese Utility Model Application Laid-Open No. 61-192185).

A heat exchanger of the mesh fin type, as illustrated in FIGS. 10 and 11, comprises a multiplicity of heat transfer tubes 1, 1 . . . arranged in parallel, a multiplicity of mesh-form fins 2, 2 . . . arranged parallel to the axes of the heat transfer tubes 1, 1 . . . and joined to the outer peripheries of the heat transfer tubes 1, and tube plates 3 supporting the heat transfer tubes 1, 1 . . . at the ends thereof. The heat transfer tubes 1 and the mesh-form fins 2 are joined together usually by soldering or brazing after the mesh-form fins 2, 2 . . . are tightly held against the heat transfer tubes 1 from opposite sides thereof.

For the purpose of holding the mesh-form fins 2, 2 . . . against the heat transfer tubes 1, 1 . . . from opposite sides thereof as aforesaid, however, one problem is that the mesh-form fins 2, 2 be preformed at predetermined locations with grooves conforming to the outer peripheral surface of the heat transfer tubes 1. Another problem is that the process of placing mesh-form fins 2, 2 in superposed relation and fixing them together requires a high level of technical skill.

DISCLOSURE OF THE INVENTION

The present invention has been made in view of the above noted problems and it is an object of the invention to provide for improvement in the process of assembling heat transfer tubes and mesh-form fins together.

The mesh fin type heat exchanger according to claim 1 is a mesh fin type heat exchanger by comprising a plurality of heat transfer tubes arranged in parallel and a plurality of mesh-form fins arranged parallel to axes of the heat transfer tubes thereof and joined to the heat transfer tubes, characterized in that each of the heat transfer tubes consists of a pair of tube component members having a half cylindrical configuration, the tube component members having, at their respective circumferential ends, joint portions extending along the axis of the heat transfer tube, the opposed joint portions of the tube component members being joined together externally of the fins in such a way as to sandwich the fins between them.

The mesh fin type heat exchanger of claim 2 is characterized in that the fins are arranged so that a part of the fins extends through the heat transfer tube.

The mesh fin type heat exchanger of claim 3 is characterized in that portions of the fins which are located within the heat transfer tube comprise portions joined to the joint portion by being sandwiched between the joint portions, and portions projecting a predetermined length from the joined portions into the heat transfer tube in a flared fashion, there being no fin present in the middle of the heat transfer tube.

The mesh fin type heat exchanger of claim 4 is characterized in that two outermost ones of the fins sandwiched between the joint portions extend through the heat transfer tube, and in that portions present within the heat transfer tube of fins other than the two outermost fins comprise portions joined to the joint portion by being sandwiched between the joint portions, and portions projecting a predetermined length from the joined portions into the heat transfer tube in a flared fashion, there being no fin present between the outermost fins in the middle of the heat transfer tube.

The mesh fin type heat exchanger of claim 5 is characterized in that a fin located central of the fins sandwiched between the joint portions extends through the heat transfer tube, and in that portions present within the heat transfer tube of fins located at both sides of the central fin comprise portions joined to the joint portion by being sandwiched between the joint portions, and portions projecting a predetermined length from the joined portions into the heat transfer tube in a flared fashion, there being no fin present at both sides of the central fin in the middle of the heat transfer tube.

The method of making a mesh-fin type heat exchanger according to claim 6 comprises the steps of stacking a plurality of mesh-form fins and pressing against the fins at a predetermined location a pair of tube component members of a half cylindrical configuration having axially extending joint portions at their respective circumferential ends, from outer side of the fins in such a way that the joint portions are opposed to each other; and joining the opposed joint portions together to form a heat transfer tube.

The heat exchanger of claim 7 is characterized in that the joint portions are joining flanges.

The heat exchangers of claims 1 to 5 and the method of making a heat exchanger of claim 6 have the following function.

According to the heat exchanger of claim 1, in a heat exchanger including a plurality of heat transfer tubes arranged in parallel, and a plurality of mesh-form fins arranged parallel to the axes of the tubes and joined to the tubes, each of the heat transfer tubes consists of a pair of tube component members having a half cylindrical configuration, the component members having, at their respective circumferential ends, joint portions extending along axis of the tube. The opposed joint portions of the tube component members are joined together externally of the fins in such a manner as to sandwich them between the joint portions. In this way, through a very simple step of joining the opposed joint portions of a pair of tube component members externally of mesh-form fins stacked in plurality, the heat transfer tubes and the mesh-form fins can be assembled in combination, which results in remarkable improvement in working efficiency during the process of heat exchanger making.

Parts of the mesh-form fins remain present within each heat transfer tube, and this allows direct contact between a fluid (e.g., refrigerant) flowing in the heat transfer tube and a part of the fins, resulting in improved heat transfer performance.

According to the heat exchanger of claim 2, a part of mesh-form fins extends through a heat transfer tube, and this permits direct contact between the fin and the fluid flowing in the heat transfer tube, resulting in exceeding improvement in heat exchange performance.

According to the heat exchanger of claim 3, direct heat exchange is effected between the fluid in each heat transfer tube and the fins by virtue of the flaredly projecting fin portion in the heat transfer tube. The flaredly projecting fin portion serves to prevent the mesh-form fin from slipping out of the joint portions. Further, in the heat exchanger of claim 3, since no fin is present in the middle of the heat transfer tube, the resistance to fluid flow in the heat transfer tube is reduced.

According to the heat exchanger of claim 4, only two outermost fins in each heat transfer tube extend through the heat transfer tube. This realizes smaller flow resistance than that in a heat exchanger in which all the fins extend through each heat transfer tube. The flaredly projecting fin portion within the heat transfer tube goes into direct contact with the fluid in the heat transfer tube for heat exchange, which results in increased heat exchange efficiency. Also, it prevents fins from slipping out of the joint portions.

According to the heat exchanger of claim 5, only the centrally located fin in each heat transfer tube extends through the tube. This realizes smaller flow resistance than that in a heat exchanger in which all the fins extend through each heat transfer tube. The flaredly projecting fin portion within the heat transfer tube goes into direct contact with the fluid in the heat transfer tube for heat exchange, which results in increased heat exchange efficiency. Also, it prevents fins from slipping out of the joint portions.

According to the method of making a heat exchanger of claim. 6, after stacking a plurality of mesh-form fins, a pair of tube component members of a half cylindrical configuration having axially extending joint portions at their respective circumferential ends is pressed against the fins at a predetermined location, from outer side of the fins in such a way that the joint portions are opposed to each other, and then the opposed joint portions are joined together to form a heat transfer tube. Thus, heat transfer tubes and mesh-form fins can be assembled together by such a very simple process, which results in remarkable improvement in the working efficiency during the process of heat exchanger making.

Further, according to this method, some of the mesh-form fins remain present within the heat transfer tube, and this allows direct contact between a fluid (e.g., refrigerant) flowing in the heat transfer tube and a part of the fins, resulting in improved heat transfer performance.

BEST MODE FOR CARRYING OUT THE INVENTION

Some preferred embodiments of the present invention will now be described with reference of FIGS. 1 through 9 of the accompanying drawings.

Figure 10:
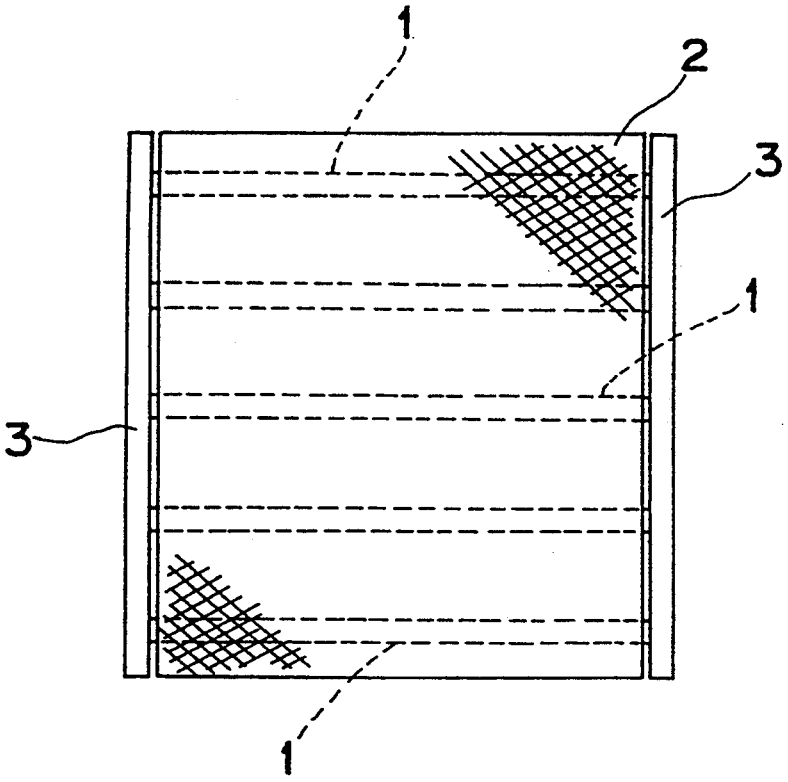
Fig. 10 PRIOR ART
FIG. 10 is a front view showing a mesh-fin type heat exchanger known in the art.
Figure 11:
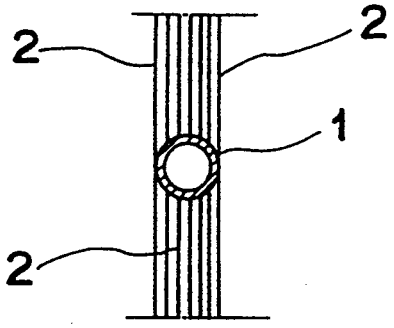
Fig. 11 PRIOR ART
FIG. 11 is a sectional view of principal portions of the known mesh-fin type heat exchanger.

Each of the heat exchangers of the following embodiments includes a multiplicity of heat transfer tubes 1, 1 . . . arranged in parallel, and a multiplicity of mesh-form fins 2, 2 . . . arranged parallel to the axes of the heat transfer tubes 1, 1 . . . and joined to the heat transfer tubes, as does the mesh-fin type heat exchanger noted in the description of the prior art (see FIGS. 10 and 11). It is noted in this connection that in the present invention, heat transfer tubes 1, 1 may be parallel to each other in any way; for example, they may be arranged in a staggered fashion and parallel to each other on both sides of one plane. In that case, mesh-form fins will be curved in a wave-like pattern.

(Embodiment 1)

Figure 1:
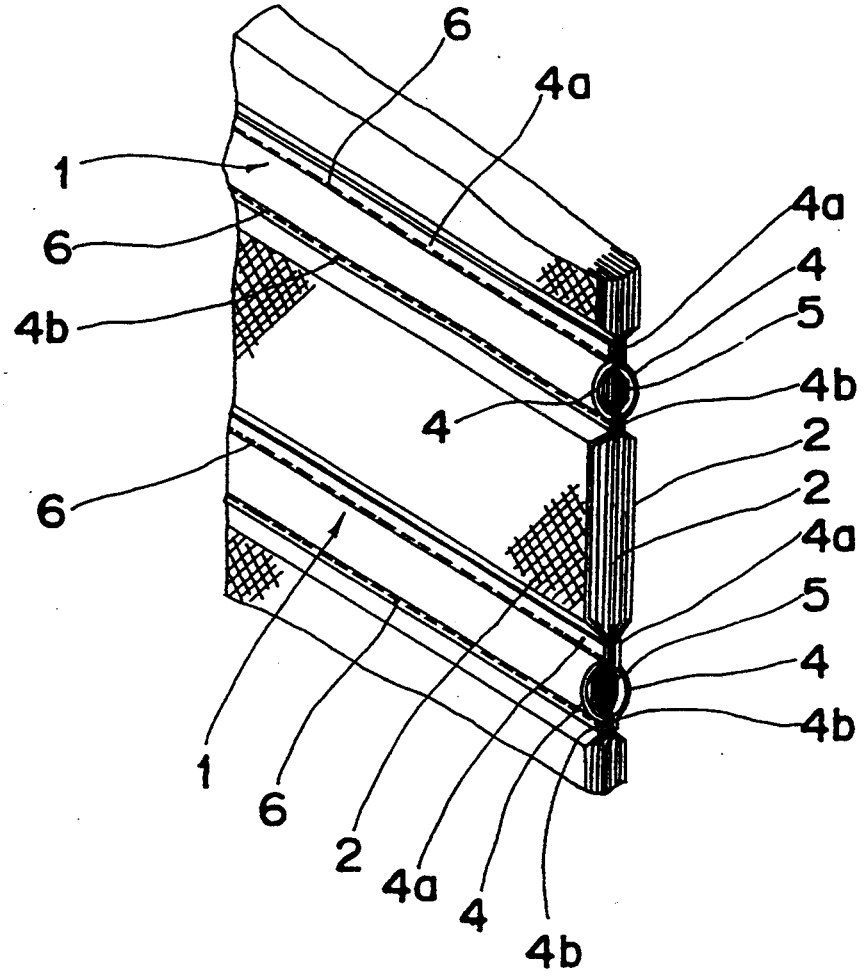
FIG. 1 is a perspective view showing principal portions of a heat exchanger representing Embodiment 1 of the present invention.
Figure 2:
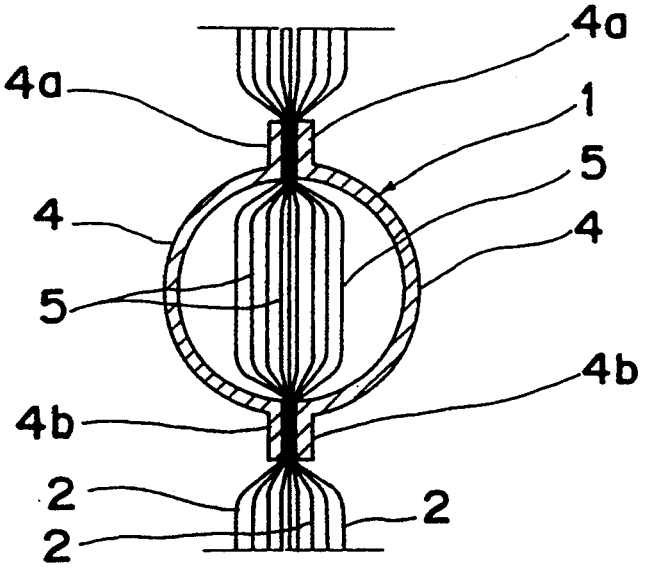
FIG. 2 is a sectional view showing principal portions of the heat exchanger of Embodiment 1 of the invention.
Figure 3:
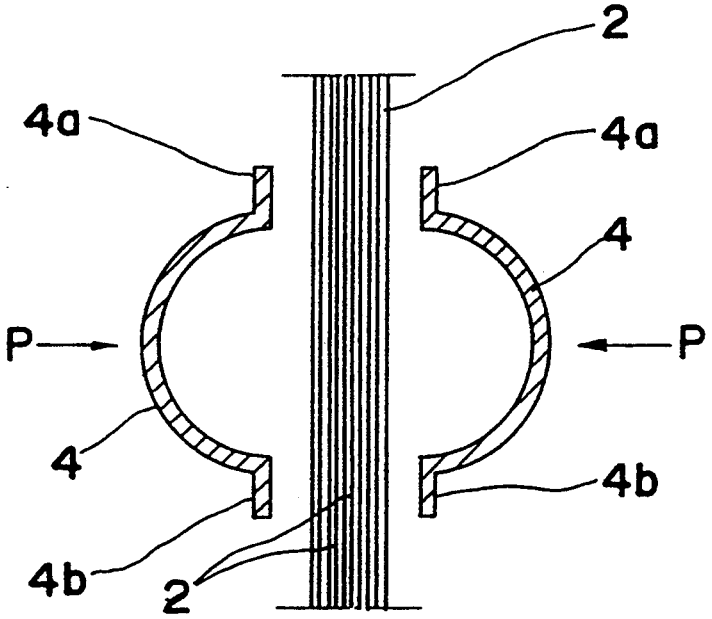
FIG. 3 is a sectional view showing the procedure of making the heat exchanger of Embodiment 1 of the invention.

In FIGS. 1 to 3, there are illustrated principal portions of a heat exchanger of Embodiment 1 of the present invention. This embodiment corresponds to the aspects of the invention according to claims 1, 2 and 6.

In the heat exchanger of the present embodiment, as FIGS. 1 and 2 illustrate, each heat transfer tube 1 consists of a pair of tube component members 4, 4 having a half cylindrical configuration, and having at their respective circumferential ends, joining flanges 4*a*, 4*b* extending along the axis of the heat transfer tube which act as joint portions.

The opposed joining flanges 4*a*, 4*a* and 4*b*, 4*b* of the tube component members 4, 4 are joined together to sandwich the mesh-form fins 2, 2 . . . by being pressed against the fins externally thereof. Reference numeral 5 designates inner fins formed by parts of the mesh-form fins 2, 2 . . . being within the heat transfer tube 1.

A heat exchanger of such construction is manufactured in the following manner.

As FIG. 3 illustrates, a multiplicity of mesh-form fins 2, 2 . . . are stacked together, and a pair of tube component members 4, 4 are pressed against the mesh-form fins 2, 2 . . . at a predetermined location externally of the fins as arrows P indicate. Thereafter, the opposed joining flanges 4*a*, 4*a*, and 4*b*, 4*b* are joined together to form a heat transfer tube 1. For the purpose of such joining operation, for example, laser welding or ultrasonic welding is advantageously employed. In the case of pressing the tube component members 4, 4 against the mesh-form fins 2, 2 where it is required that the mesh-form fins 2, 2 . . . be spaced apart from one another, spacing means (e.g., spacer) for keeping the mesh-form fins 2, 2 . . . spaced apart may be used. The spacing means is removed after the heat exchanger has been manufactured. Reference numeral 6 in FIG. 1 designates laser weld or ultrasonic weld spots.

In the present embodiment, as above described, assembling together of heat transfer tubes 1, 1 . . . and mesh-form fins 2, 2 . . . can be accomplished by a very simple process such that the opposed joining flanges 4*a*, 4*a* and 4*b*, 4*b* of a pair of tube component members 4, 4 are pressed against a multiplicity of mesh-form fins stacked together externally thereof, being thereby joined together. This provides for remarkable improvement in working efficiency during the process of making a heat exchanger. Further, the fact that parts of the mesh-form fins 2, 2 . . . are retained within the heat transfer tubes 1, 1 . . . to form inner fins 5, 5 . . . permits direct contact between the fluid (e.g., refrigerant) flowing in the heat transfer tubes 1, 1 . . . and parts of the mesh-form fins 2, 2 . . . (i.e., inner fins 5, 5 . . . ), resulting in improvement in the heat transfer performance.

(Embodiment 2)

Figure 4:
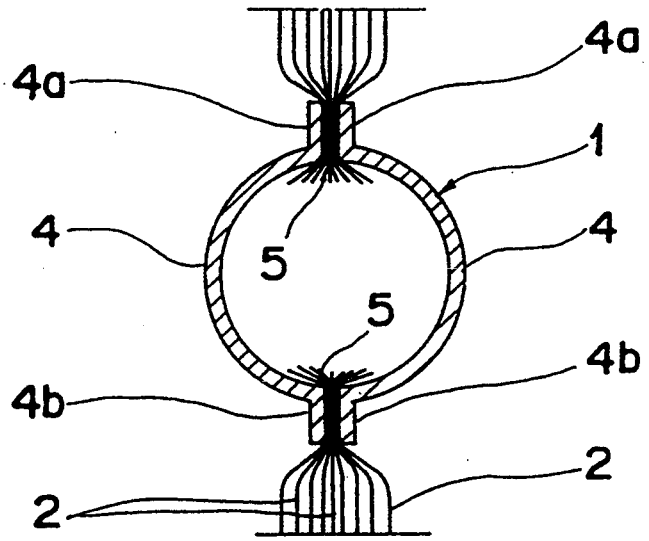
FIG. 4 is a sectional view showing principal portions of a heat exchanger of Embodiment 2 of the invention.
Figure 5:
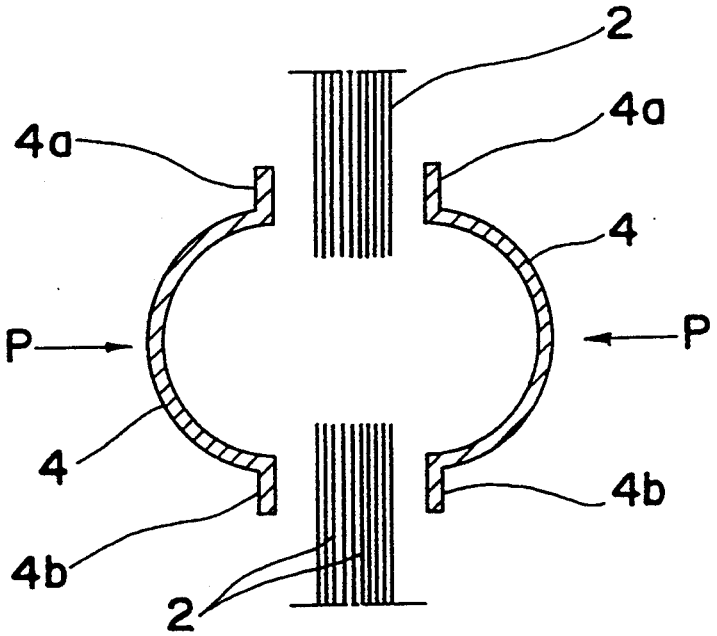
FIG. 5 is a sectional view showing the procedure of making the heat exchanger of Embodiment 2 of the invention.

In FIGS. 4 and 5, there are illustrated principal portions of a heat exchanger of Embodiment 2 of the present invention. This embodiment corresponds to the aspects of the invention as defined in claims 1, 3 and 6.

In the present embodiment, portions of the mesh-form fins 2, 2 . . . to be located within each heat transfer tube 1 are cut off except portions against which opposed joining flanges 4*a*, 4*a* and 4*b*, 4*b* of tube component members 4, 4 are pressed, and portions 5 projecting therefrom slightly into the heat transfer tube 1 in a flared fashion. In this case, inner fins consist of short portions 5 projecting flaredly from the joint portions into the heat transfer tube 1. Therefore, the flow resistance of the fluid (e.g., refrigerant) flowing in the heat transfer tube 1 can be greatly reduced, and mesh-form fins 2, 2 can be prevented from slipping out of the joint portions. Other structural and functional features and effects of the embodiment are same as those of Embodiment 1.

(Embodiment 3)

Figure 6:
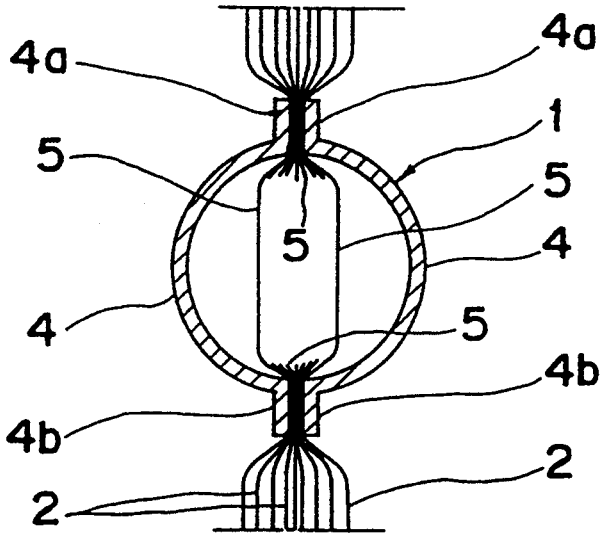
FIG. 6 is a sectional view showing principal portions of a heat exchanger of Embodiment 3 of the invention.
Figure 7:
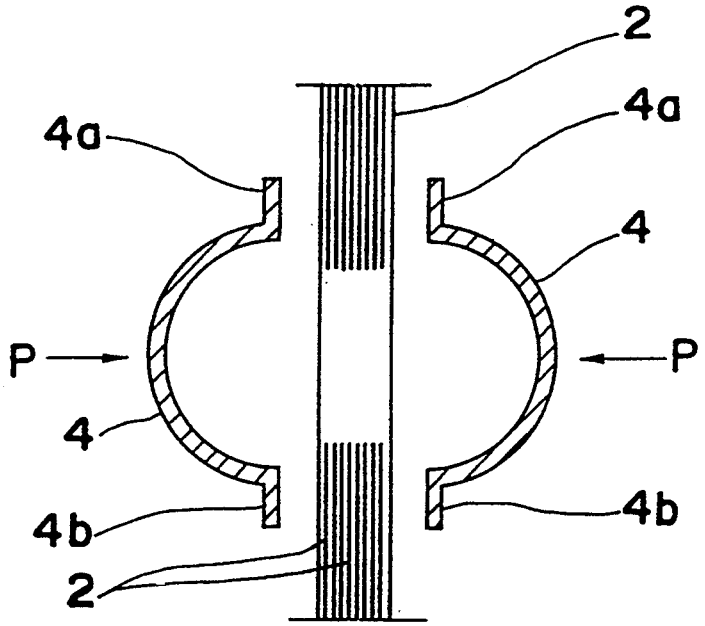
FIG. 7 is a sectional view showing the procedure of making the heat exchanger of Embodiment 3 of the invention.

In FIGS. 6 and 7, there are illustrated principal portions of a heat exchanger of Embodiment 3 of the present invention. This embodiment corresponds to the aspects of the invention as defined in claims 1, 4 and 6.

In the present embodiment, portions of mesh-form fins 2, 2 . . . to be located within the heat transfer tube 1 are cut off except outermost mesh-form fins 2, 2. That is, the outermost mesh-form fins 2, 2 remain as they are, and the other mesh-form fins 2, 2 . . . within the heat transfer tube 1 are cut off except portions against which opposed joining flanges 4*a*, 4*a* and 4*b*, 4*b* of tube component members 4, 4 are pressed, and portions 5 projecting flaredly therefrom. In the case of this embodiment as well, the flow resistance of the fluid (e.g., refrigerant) flowing in the heat transfer tube 1 can be greatly reduced. Other structural and functional features and effects of the embodiment are same as those of Embodiments 1 and 2.

(Embodiment 4)

Figure 8:
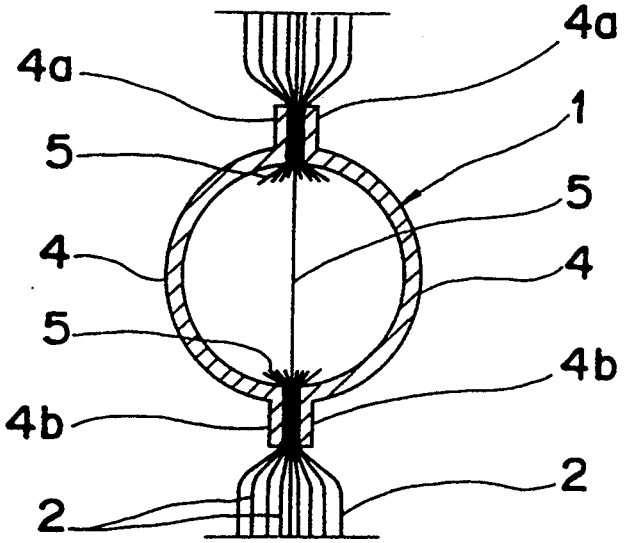
FIG. 8 is a sectional view showing principal portions of a heat exchanger of Embodiment 4 of the invention.
Figure 9:
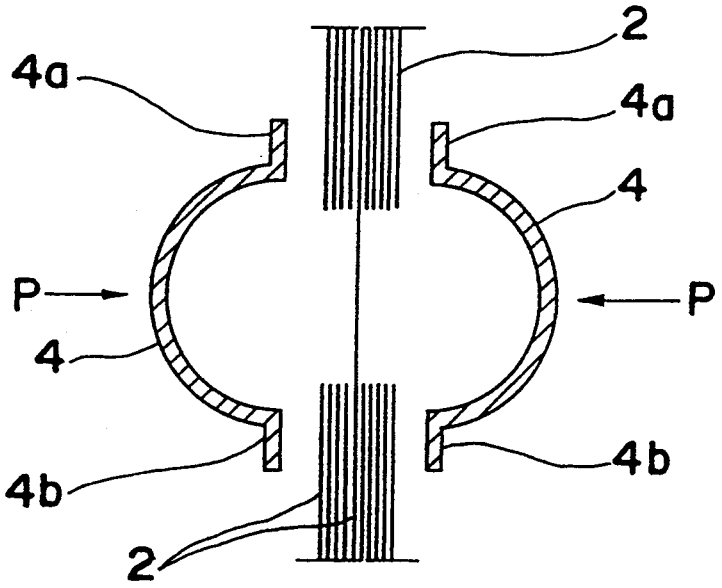
FIG. 9 is a sectional view showing the procedure of making the heat exchanger of Embodiment 4 of the invention.

In FIGS. 8 and 9, there are illustrated principal portions of a heat exchanger of Embodiment 4 of the present invention. This embodiment corresponds to the aspects of the invention as defined in claims 1, 5 and 6.

In the present embodiment, portions of mesh-form fins 2, 2 . . . to be located within the heat transfer tube 1 are cut off except portions against which opposed joining flanges 4*a*, 4*a* and 4*b*, 4*b* of tube component members 4, 4 are pressed, portions 5 projecting a short distance therefrom in a flared fashion and a mesh-form fin 5 positioned in the middle of the heat transfer tube 1. In the case of this embodiment as well, the flow resistance of the fluid (e.g., refrigerant) flowing in the heat transfer tube 1 can be greatly reduced. Other structural and functional features and effects of the embodiment are same as those of Embodiments 1 and 2.

In the foregoing embodiments, joining flanges are used as Joint portions; alternatively, faucet Joints or the like may be used.

INDUSTRIAL APPLICABILITY

The mesh-fin type heat exchangers of the present invention are applicable for use in air conditioners, refrigerators, and the like.

We claim:

1. A mesh fin type heat exchanger comprising a plurality of heat transfer tubes (1), (1) . . . arranged in parallel and a plurality of mesh-form fins (2), (2) . . . arranged parallel to axes of the heat transfer tubes and joined to the heat transfer tubes (1), (1) . . . , characterized in that:

each of the heat transfer tubes (1) consists of a pair of tube component members (4), (4) having a half cylindrical configuration, the tube component members having, at their respective circumferential ends, joint portions (4*a*), (4*b*) extending along the axis of the heat transfer tube, the opposed joint portions (4*a*), (4*b*) of the tube component members (4), (4) being joined together externally of the fins (2), (2) . . . in such a way as to sandwich the fins (2), (2) . . . between them.

2. The mesh fin type heat exchanger of claim 1, wherein the fins (2), (2) . . . are arranged so that a part of the fins (2), (2) . . . extends through the heat transfer tube (1) .

3. The mesh fin type heat exchanger of claim 1, wherein portions of the fins (2), (2) which are located within the heat transfer tube (1) comprise portions joined to the joint portion by being sandwiched between the joint portions (4*a*), (4*b*) and portions projecting a predetermined length from the joined portions into the heat transfer tube (1) in a flared fashion, there being no fin (2) present in the middle of the heat transfer tube (1).

4. The mesh fin type heat exchanger of claim 1, wherein two outermost fins (2), (2) of the fins (2), (2) . . . sandwiched between the joint portions extend through the heat transfer tube (1), and wherein portions present within the heat transfer tube (1) of fins (2), (2) . . . other than the two outermost fins (2), (2) comprise portions joined to the joint portion by being sandwiched between the joint portions (4*a*), (4*b*), and portions projecting a predetermined length from the joined portions into the heat transfer tube (1) in a flared fashion, there being no fin present between the outermost fins (2), (2) in the middle of the heat transfer tube (1).

5. The mesh fin type heat exchanger of claim 1, wherein a fin (2) located central of the fins (2), (2) . . . sandwiched between the joint portions extends through the heat transfer tube (1), and wherein portions present within the heat transfer-tube (1) of fins (2), (2) . . . located at both sides of the central fin (2) comprise portions joined to the joint portion by being sandwiched between the joint portions (4*a*), (4*b*) and portions projecting a predetermined length from the joined portions into the heat transfer tube (1) in a flared fashion, there being no fin present at both sides of the central fin (2) in the middle of the heat transfer tube (1).

6. The heat exchanger according to any one of claims 1 to 5, wherein the joint portions (4*a*), (4*b*) are joining flanges (4*a*) , (4*b*) .

7. A method of making a mesh-fin type heat exchanger which comprises the steps of:

stacking a plurality of mesh-form fins (2), (2) and pressing against the fins (2), (2) . . . at a predetermined location a pair of tube component members (4), (4) of a half cylindrical configuration having axially extending joint portions (4*a*), (4*b*) at their respective circumferential ends, from outer side of the fins in such a way that the joint portions (4*a*), (4*b*) are opposed to each other; and joining the opposed joint portions (4*a*), (4*b*) together to form a heat transfer tube (1).

* * * * *